US010176950B2

(12) United States Patent
Nishio

(10) Patent No.: US 10,176,950 B2
(45) Date of Patent: Jan. 8, 2019

(54) LATCHING RELAY DRIVE CIRCUIT

(71) Applicant: OMRON Corporation, Kyoto-shi, Kyoto (JP)

(72) Inventor: Norikazu Nishio, Takatsuki (JP)

(73) Assignee: OMRON Corporation, Kyoto-shi (JP)

( * ) Notice: Subject to any disclaimer, the term of this patent is extended or adjusted under 35 U.S.C. 154(b) by 158 days.

(21) Appl. No.: 15/119,398

(22) PCT Filed: Dec. 8, 2014

(86) PCT No.: PCT/JP2014/082401

§ 371 (c)(1),
(2) Date: Aug. 17, 2016

(87) PCT Pub. No.: WO2015/136797

PCT Pub. Date: Sep. 17, 2015

(65) Prior Publication Data

US 2017/0062163 A1 Mar. 2, 2017

(30) Foreign Application Priority Data

Mar. 13, 2014 (JP) ..... 2014-050064

(51) Int. Cl.
*H01H 47/22* (2006.01)
*H01F 7/18* (2006.01)
(Continued)

(52) U.S. Cl.
CPC ..... *H01H 47/22* (2013.01); *H01F 7/1844* (2013.01); *H01H 47/226* (2013.01);
(Continued)

(58) Field of Classification Search
USPC ..... 361/139, 144, 160
See application file for complete search history.

(56) References Cited

U.S. PATENT DOCUMENTS 4,257,081 A * 3/1981 Sauer ..... H01H 47/226 361/156
6,021,038 A 2/2000 Hanchett, Jr.
(Continued)

FOREIGN PATENT DOCUMENTS

JP S58-137931 A 8/1983
JP S61-178241 U 11/1986
(Continued)

OTHER PUBLICATIONS

Hans Sauer, "Relais-Lexikon", Jan. 1, 1985, pp. 215-219, vol. 2, Hüthig, Heidelberg, DE, Relevance is indicated in the extended European Search Report issued on Oct. 4, 2017.
(Continued)

*Primary Examiner* — Danny Nguyen
(74) *Attorney, Agent, or Firm* — Metrolexis Law Group, PLLC

(57) ABSTRACT

A latching relay drive circuit includes a transistor that goes off when an operation switch is open, and a transistor connected in parallel to a capacitor and an operation coil. The transistor comes on when the transistor goes off to allow a reset current to flow into the operation coil. Accordingly, an enough reset current can be supplied, even if a power supply is shut off due to a power failure, to securely recover a single winding latching relay.

11 Claims, 14 Drawing Sheets

(51) Int. Cl.
*H01H 47/32* (2006.01)
*H01H 47/00* (2006.01)

(52) U.S. Cl.
CPC ..... *H01H 47/32* (2013.01); *H01H 47/002* (2013.01); *Y10T 307/76* (2015.04)

(56) References Cited

U.S. PATENT DOCUMENTS

| | | | | |
|---|---|---|---|---|
| 8,023,242 | B2 * | 9/2011 | Knopf | H01H 47/226 361/139 |
| 2014/0211363 | A1 * | 7/2014 | Oebser | H01H 47/32 361/190 |

FOREIGN PATENT DOCUMENTS

| | | | |
|---|---|---|---|
| JP | S62-55826 | A | 3/1987 |
| JP | H02-51817 | A | 2/1990 |

OTHER PUBLICATIONS

The extended European search report dated Oct. 4, 2017 in the counterpart European patent.

* cited by examiner

Static characteristic of emitter grounded transistor

LATCHING RELAY DRIVE CIRCUIT

TECHNICAL FIELD

The present invention relates to a latching relay drive circuit for driving a single winding latching relay that operates or recovers when an excitation input is applied to a coil, and keeps its state after the excitation input is removed.

BACKGROUND ART

A conventionally known latching relay drive circuit is a one in which a capacitor is disposed in series to an operation coil disposed in a single winding latching relay (Patent Documents 1 and 2).

(Configuration of Conventional Latching Relay Drive Circuit)

FIG. 9 is a circuit diagram illustrating a configuration of a conventional latching relay drive circuit disclosed in Patent Document 1. The latching relay drive circuit includes a power supply 51, a current control resistor 52, a power switch 53, a load 55, and a hybrid relay 54 for open-close controlling the load 55. This hybrid relay 54 is configured in such a manner that a series circuit including an operation coil 57 of a latching relay and a capacitor 58 is connected to output terminals of a Schmitt circuit 56, and a transistor 59 for recovering this operation coil 57 is connected in parallel. The hybrid relay 54 is disposed with a base resistor 60 for the transistor 59 and a diode 61 for off-operating the transistor 59. A relay contact 62 for the latching relay is disposed between the power switch 53 and the load 55.

(Operation of Conventional Latching Relay Drive Circuit)

First, when the power switch 53 is closed, power is supplied from the power supply 51, via the Schmitt circuit 56, to the operation coil 57, and the power remains until the capacitor 58 is fully charged. By the power to this operation coil 57, its relay contact 62 turns on, thus the power is supplied from the power supply 51, via the relay contact 62, to the load 55. When the power is supplied to the above-described operation coil 57, a current flows in a forward direction to the diode 61.

As a result, no potential difference occurs between a base and an emitter of the transistor 59, thus this transistor 59 does not on-operate, but the power is supplied to the operation coil 57.

Next, when the power supply switch 53 is open, a charging voltage in the capacitor 58 is applied in a backward direction to the diode 61. When this reverse voltage is applied between the base and the emitter of the transistor 59, this transistor 59 on-operates to allow a charging current to instantaneously flow in a backward direction from the capacitor 58 to the latching relay 57. Accordingly, the relay contact 62 turns off to shut off the power to the load 55 at a high speed.

(Configuration of Another Conventional Latching Relay Drive Circuit)

FIG. 10 is a circuit diagram illustrating a configuration of another conventional latching relay drive circuit, disclosed in Patent Document 2. This latching relay drive circuit includes an alternating current power supply AC. Both ends of the alternating current power supply AC are connected with a surge absorber ZN via a switch SW. Both ends of the surge absorber ZN are connected with a full-wave rectifying circuit DB including a diode bridge, via a resistor Rs for protecting from a surge current.

Between output terminals of this full-wave rectifying circuit DB, collectors and emitters of transistors $Tr_{71}$ and $Tr_{72}$, a diode $D_{71}$, a capacitor $C_{71}$, and an operation coil Ly of a single winding latching relay are sequentially connected in series so as to configure a constant voltage circuit. A resistor $R_{71}$ is connected between the collector and a base of the transistor $Tr_{71}$, and a resistor $R_{72}$ is connected between the base of the transistor $Tr_{71}$ and a base of the transistor $Tr_{72}$. Between the base of the transistor $Tr_{72}$ and a negative pole output end of the full-wave rectifying circuit DB, a Zener diode ZD is connected.

A smoothing capacitor $C_{72}$ configuring a delay circuit, and a series circuit including voltage-dividing resistors $R_{73}$ and $R_{74}$ are connected in parallel between the emitter of the transistor $Tr_{72}$ and the negative pole output end of the full-wave rectifying circuit DB. A coupling point between the resistor $R_{73}$ and the resistor $R_{74}$ is connected to a base of a transistor $Tr_{73}$ that connects its emitter to the negative pole output end of the full-wave rectifying circuit DB.

Between an end of the capacitor $C_{72}$ and a collector of the transistor $Tr_{73}$, a series circuit including a diode $D_{72}$, a resistor $R_{75}$, and a base and an emitter of a transistor $Tr_4$, and another series circuit including a diode $D_{73}$, a resistor $R_{76}$, and a collector and an emitter of a transistor $Tr_{75}$ are connected.

A cathode of the diode $D_{73}$ is connected to a base of a transistor $Tr_{76}$. An emitter of the transistor $Tr_{76}$ is connected to a cathode of the diode $D_{71}$. A collector of the transistor $Tr_{76}$ is connected to both of a base of the transistor $Tr_{75}$ and a collector of a transistor $Tr_{74}$. Between the emitter and the collector of the transistor $Tr_{76}$, a resistor $R_{77}$ is connected to provide a higher resistance.

The transistor $Tr_{74}$ configures a switching circuit to control a thyristor structure including the transistors $Tr_{75}$ and $Tr_{76}$.

(Operation of Another Conventional Latching Relay Drive Circuit)

First, when the switch SW is closed, the full-wave rectifying circuit DB rectifies an alternating-current voltage. The rectified voltage is then smoothed by the capacitor $C_{72}$, via the constant voltage circuit including the transistors $Tr_{71}$ and $Tr_{72}$, the resistors $R_{71}$ and $R_{72}$, and the Zener diode ZD. When this direct current voltage is divided by the resistors $R_{73}$ and $R_{74}$, and the voltage between both ends of the resistor $R_{74}$ reaches a value between 0.6 and 0.7 V, the transistor $Tr_{73}$ comes on. And then, a charging current of the capacitor $C_{72}$ flows from a point "a" shown in FIG. 10, via the diode $D_{71}$, the capacitor $C_{71}$, and the operation coil Ly, toward the transistor $Tr_{73}$, so that the latching relay is set, i.e. is on-operated.

Next, when the switch SW is open, an electric charge in the capacitor $C_{72}$ discharges via the resistors $R_{73}$ and $R_{74}$. Meanwhile the voltage between both the ends of the resistor $R_{74}$ gradually drops, and then the transistor $Tr_{73}$ goes off. As the transistor $Tr_{73}$ goes off, the transistor $Tr_{74}$ configuring the switching circuit also goes off, thus a potential at the collector of the transistor $Tr_{74}$ quickly rises. That is, a positive pulse is applied to a gate (a point "b" shown in FIG. 10) of the thyristor structure including the transistors $Tr_{75}$ and $Tr_{76}$, and the transistors $Tr_{75}$ and $Tr_{76}$ quickly come on to discharge an electric charge from the capacitor $C_{71}$ via the transistors $Tr_{75}$ and $Tr_{76}$.

As a result, a discharge current (reset current) flows from the capacitor $C_{71}$, via the transistors $Tr_{76}$ and $Tr_{75}$, toward the operation coil Ly so that the latching relay is reset, i.e. is off-operated.

PRIOR ART DOCUMENTS

Patent Documents

Patent Document 1: "Japanese Unexamined Patent Publication No. S62-55826 (published on Mar. 11, 1987)"

Patent Document 2: "Japanese Unexamined Patent Publication No. S58-137931 (published on Aug. 16, 1983)"

SUMMARY OF THE INVENTION

Problems to be Solved by the Invention

Patent Document 1 describes that the latching relay drive circuit shown in FIG. 9 can quickly turn on or off the latching relay with the Schmitt circuit 56 when a voltage of the power supply 51 increases or decreases to reach a predetermined potential. However, the inventor of the present invention has found that, if the power supply is unintentionally shut off due to a power failure or other failures, without opening the power switch 53, a voltage supplied from the power supply 51 gradually drops, thus a reset current does not fully flow in the latching relay drive circuit shown in FIG. 9. As a result, the latching relay could not turn off. This problem will be more specifically described herein.

(Detailed Operation of Conventional Latching Relay Drive Circuit)

FIG. 11(*a*) is a circuit diagram for describing a detailed operation of the conventional latching relay drive circuit, and FIG. 11(*b*) is a waveform chart illustrating an input signal into the above-described latching relay drive circuit and a coil current flowing into an operation coil of a latching relay. An operation coil L of a single winding latching relay shown in FIG. 11(*a*) corresponds to the operation coil 57 of the latching relay shown in FIG. 9. A capacitor C corresponds to the capacitor 58 shown in FIG. 9. A transistor TR corresponds to the transistor 59 shown in FIG. 9. A diode D2 corresponds to the diode 61 shown in FIG. 9, and a resistor R corresponds to the base resistor 60 shown in FIG. 9.

Here will describe an operation based on an assumption as shown below: Input signal when turned on=12.0 V, Vf of diode D1=0.7 V, and Saturation voltage Vbe between base and emitter of transistor TR=0.7 V. That is, the transistor TR comes on when a base voltage is 0.7 V higher than an emitter voltage.

First, when an input signal into a terminal IN is switched on from 0 V to 12 V, a set current iS flows from the terminal IN, via the capacitor C, the operation coil L, and the diode D1, toward a ground GND until the capacitor C is fully charged (until a potential difference between a positive terminal and a negative terminal of the capacitor C reaches 11.3 V). The capacitor C does not allow a direct current to flow, thus almost no current flows into the latching relay drive circuit after the capacitor C is fully charged.

At an instant when the input signal is switched on from 0 V to 12 V, voltages at both the positive terminal and the negative terminal of the capacitor C reach 12 V. Therefore, the potential difference between the positive terminal and the negative terminal of the capacitor C becomes 0 V.

In such a manner, since the voltage at the negative terminal of the capacitor C is 12.0 V, a set current iS flows from the negative terminal, via the coil L and the diode D1, toward the ground GND. As a result of the set current iS flowed as described above, the voltage at the negative terminal of the capacitor C drops from 12.0 V to 0.7 V. Since the voltage Vf of the diode D2 is 0.7 V at this time, when a voltage at an anode of the diode D2 becomes 0.7 V, a potential difference between the negative terminal of the capacitor C and an anode of the diode D1 becomes 0 V. Accordingly, the above-described set current iS stops.

The latching relay drive circuit becomes steady in this state. The transistor TR comes on when a base voltage is 0.7 V higher than an emitter voltage. This means that, since the emitter voltage is 0.7 V, while the base voltage is 0 V at a steady state, i.e. the emitter voltage is higher than the base voltage, the transistor TR goes off. As a result, a current flows from the terminal IN, via the resistor R, toward the ground GND while the input signal is kept on (12 V).

Next, when the input signal is switched off from 12 V to 0 V, the transistor TR comes on, the capacitor C discharges, and a reset current iR flows from the positive terminal of the capacitor C, via the transistor TR and the operation coil L, toward the negative terminal of the capacitor C. Upon the capacitor C fully discharges and the transistor TR goes off (a state of the transistor TR enters into a shut off region), the reset current iR stops.

At an instant when the input signal is switched off from 12 V to 0 V, the voltage at the positive terminal of the capacitor C drops from 12.0 V to 0.0 V. Since the potential difference between the positive terminal and the negative terminal of the capacitor C is 11.3 V, the voltage at a terminal on a negative side of the capacitor C becomes −11.3 V. Now, an operation at an instant when a voltage at the positive terminal of this capacitor C drops from 12.0 V to 0.0 V will be described herein in details.

When a voltage of an input signal drops, the voltage between the positive terminal and the negative terminal of the capacitor C drops while a potential difference of 11.3 V between the positive terminal and the negative terminal of the capacitor C is kept maintained. When the above-described voltage drops 1.4 V from 12.0 V where the voltage at the positive terminal becomes 10.6 V, and the voltage at the negative terminal becomes −0.7 V, an emitter voltage in the transistor TR becomes −0.7 V. Since a base voltage in the transistor TR is 0.0 V, which is 0.7 V higher than the emitter voltage of −0.7 V, the transistor TR turns from off to on.

When the voltage between the positive terminal and the negative terminal of the capacitor C continuously drops, while the potential difference of 11.3 V between the positive terminal and the negative terminal of the capacitor C is kept maintained, and the input voltage finally reaches 0.0 V, the voltage at the positive terminal of the capacitor C becomes 0.0 V, and the voltage at the negative terminal becomes −11.3 V. While the transistor TR is turned on, the base voltage is kept 0.7 V higher than the emitter voltage, thus the emitter voltage of −0.7 V is kept maintained.

Until the potential difference of 10.6 V between the emitter voltage of −0.7 V and the voltage of −11.3 V at the negative terminal of the capacitor C disappears, a reset current iR flows from the positive terminal of the capacitor C, via the transistor TR and the operation coil L, toward the negative terminal of the capacitor C.

However, if a longer time is required for an input signal to drop from a voltage of 12 V to 0 V (if a voltage drop rate of the input signal is low), such a reset current could not flow easily.

FIG. 12(*a*) is a graph illustrating a relationship between a base current $I_B$ and a voltage $V_{be}$ between the base and the emitter of the transistor TR disposed in the above-described latching relay drive circuit, and FIG. 12(*b*) is a graph illustrating a static characteristic between a collector current $I_C$ (reset current iR) and a voltage $V_{CE}$ between a collector and the emitter of the above-described transistor TR.

In the transistor TR, if the voltage $V_{be}$ between the base and the emitter is below 0.7 V, a base current $I_B$ does not flow much. In an active region where the base current $I_B$ does not flow much, the collector voltage $V_{CE}$ becomes larger, a loss in the transistor TR increases, and the collector current $I_C$ does not flow much. As the collector current $I_C$ flows, an electric charge in the capacitor C discharges with time, thus a load line shifts to an origin.

If a normally off operation of the power switch 53 causes an input voltage to steeply drop, the transistor TR quickly changes from a state $P_{off}$ in the active region, along a load line r1, to a state $P_{on}$ in a saturation region. After that, as the load line shifts due to that the capacitor discharges electricity, the state of the transistor TR changes along a line r2 in the saturation region. Therefore, the normally off operation of the power switch 53 causes an enough collector current $I_C$ (reset current) to flow.

However, when an input voltage slowly drops, the voltage $V_{be}$ between the base and the emitter slowly changes, which requires a longer time to move in the active region, thus a larger collector voltage $V_{CE}$ extends (a loss in the transistor TR increases). The state of the transistor TR slowly changes from the state $P_{off}$ in the active region, as the load line r1 shifts in a direction toward the origin, along a line r3.

If a loss in the transistor TR is larger, a reset current iR does not flow fully. In addition, while a larger loss in the transistor TR extends longer, the transistor TR consumes more electric charge in the capacitor C, thus the reset current iR becomes difficult to further flow into the coil L. Therefore, the more a voltage drop rate of an input voltage lowers, the more a reset current iR does not flow fully.

FIG. 13 is a waveform chart illustrating an input voltage and an output voltage in the Schmitt circuit, in the normally off operation of the above-described latching relay drive circuit. In the latching relay drive circuit shown in FIG. 9, even though the input voltage $V_{in}$ into the Schmitt circuit 56 slowly changes due to that the power switch 53 is open or close, the Schmitt circuit 56 causes the output $V_{out}$ from the Schmitt circuit 56 itself to steeply change. Moreover, as the power switch 53 actually operates steeply, the output $V_{out}$ steeply changes even if there is no Schmitt circuit 56.

FIG. 14 is a waveform chart illustrating an input voltage and an output voltage in the Schmitt circuit, in an off operation of the above-described latching relay drive circuit when the power supply is shut off due to a power failure or other failures, rather than that the power switch 53 is open. When a voltage supplied from the power supply 51 slowly drops due to a power failure, while the power switch 53 is kept closed, a power supply voltage in the Schmitt circuit 56 also slowly drops. Therefore, the output $V_{out}$ from the Schmitt circuit 56 slowly drops in voltage along with a gentle voltage drop curve of the power supply 51. At this time, a voltage drop period of approximately 250 msec (a fall time from 90% to 10% of 200 msec) has generally been observed, even though the value differs depending on a system, for the power supply 51 when the power supply is off-operated when the power supply is shut off.

In an input into a circuit including the operation coil 57, the capacitor 58, the transistor 59, the base resistor 60, and the diode 61, a voltage gently drops in an off operation when the power supply is shut off, regardless of whether the Schmitt circuit 56 is present or absent, thus a reset current iR does not flow much in the above-described circuit.

FIG. 15(*a*) is a waveform chart illustrating an input voltage applied into and a reset current flowing into the hybrid relay 54 in a normally off operation through which the above-described latching relay drive circuit opens an power switch 53, and FIG. 15(*b*) is a waveform chart illustrating an input voltage and a reset current in an off operation when the power supply is shut off. In the normally off operation through which the power switch 53 is turned off, a peak value of a reset current iR is 229 mA. However, in an off operation when the power supply is shut off due to a power failure, the peak value of the reset current iR could decrease to 132 mA.

FIG. 16(*a*) is a waveform chart illustrating an input voltage (a voltage at a point "a" shown in FIG. 10) and a reset current in a normally off operation of another latching relay drive circuit than the above-described circuit, and FIG. 16(*b*) is a waveform chart illustrating an input voltage (a voltage at the point "a" shown in FIG. 10) and a reset current in an off operation when the power supply is shut off.

In the other conventional latching relay drive circuit described previously in FIG. 10, a peak value of a reset current iR in a normally off operation is 118 mA, thus a reset current flowing in the other conventional latching relay drive circuit is less than a current flowing in the conventional latching relay circuit described previously in FIG. 9, and FIGS. 15(*a*) and 15(*b*). The peak value of the reset current iR in the off operation when the power supply is shut off is 117 mA, which is approximately identical to the peak value in the normally off operation.

The other above-described latching relay drive circuit can improve an issue where, in the off operation when the power supply is shut off, a reset current decreases, thus a latching relay does not go off. However, there is another problem where a reset current becomes smaller than a current flowing in the latching relay drive circuit shown in FIG. 9 due to a loss in the transistor $Tr_{73}$ and the thyristor (transistors $Tr_{75}$ and $Tr_{76}$). In addition, since a configuration of the thyristor requires high performance transistors each having a larger rated base current so as to allow a large current to flow into the base of the transistor $Tr_{75}$, FETs cannot be used to configure the transistor $Tr_{75}$. Furthermore, still another problem with regard to a larger number of parts arises in the other above-described latching relay drive circuit shown in FIG. 10.

The present invention has an object to provide a latching relay drive circuit capable of securely recovering a single winding latching relay by supplying an enough reset current even if a power supply is shut off due to a power failure or other failures.

Means for Solving the Problem

To solve the above-described problems, a latching relay drive circuit according to the present invention includes an operation coil disposed in a single winding latching relay, a capacitor connected in series to the operation coil, an operation switch disposed to allow a set current to flow into the operation coil by charging the capacitor with a power supply, a single first switch element connected in parallel to both ends of a series circuit including the operation coil and the capacitor so as to form a closed circuit including the series circuit when the first switch element is turned on to allow a current discharged from the capacitor to flow, a first switch element drive circuit into which, from the capacitor, the discharge current that is applied into a signal input unit of the first switch element flows in response to when the operation switch is open or if a failure in supplying power from the power supply occurs, and a discharge preventing element preventing the current discharged from the capacitor from being flowed into other than the first switch element drive circuit while the operation switch is open or there is a failure in supplying power from the power supply.

According to the above-described discharge preventing element, a current discharged from the capacitor is only supplied to the first switch element drive circuit while the operation switch is open or there is a failure in supplying power from the power supply. Therefore, the first switch element drive circuit can stably supply a current discharged from the capacitor to the signal input unit of the first switch element without being affected by a rate of drop in voltage supplied from the power supply. That is, even if a rate of drop in voltage supplied from the power supply is low, a steeply rising voltage can be applied to the signal input unit of the first switch element. Accordingly, a loss in electric charge in the first switch element can be kept low, thus a reset current can be prevented from being lowered.

In addition, the capacitor is configured so that a discharge current passes through the single first switch element. Therefore, a larger reset current can be obtained, compared with a circuit in which a discharge current passes through many switch elements.

At this time, examples of "failure in supplying power from a power supply" include a blackout and an unexpected situation where a circuit breaker is shut off. A power failure is referred to as a stoppage of supplying power to users due to maintenance activities or an accident or a failure in a power generation side or a power transmission side. In addition, a power failure includes a situation where a power supply voltage slowly drops in an area in which the power supply voltage significantly fluctuates.

In addition, to solve the above-described problems, the latching relay drive circuit according to the present invention includes a first voltage-dividing circuit connected to the power supply via the operation switch, a second voltage-dividing circuit connected via a diode from a connection unit with the operation switch for the first voltage-dividing circuit, a first switch element connected in parallel to the second voltage-dividing circuit, and an LC circuit connected in parallel to the second voltage-dividing circuit, and includes an operation coil of a single winding latching relay and a capacitor. The latching relay drive circuit according to the present invention is configured in such a manner that the diode is disposed in a forward direction from the first voltage-dividing circuit toward the second voltage-dividing circuit; the first voltage-dividing circuit includes a pair of first voltage-dividing elements; the second voltage-dividing circuit includes a pair of second voltage-dividing elements; the signal input unit of the second switch element is connected between the pair of first voltage-dividing elements; a current input unit of the second switch element and the signal input unit of the first switch element are connected between the pair of second voltage-dividing elements; a current output unit of the second switch element is connected to a side opposite to the operation switch of the power supply; a voltage-dividing ratio for the pair of first voltage-dividing elements is specified so that, when the operation switch is closed, the second switch element is switched to an on state; a voltage-dividing ratio for the pair of second voltage-dividing elements is specified so that, when a charging voltage based on an electric charge in the capacitor is applied to the second voltage-dividing circuit, the first switch element is switched to an on state; when the operation switch is switched from a closed state to an open state, the second switch element is switched from an on state to an off state, and the first switch element is switched from an off state to an on state; and the electric charge in the capacitor is discharged via the first switch element to allow a reset current to flow into the operation coil.

According to these features, the first switch element can be quickly changed even if a voltage drop rate of an input voltage lowers due to a power failure. When the first switch element is quickly changed, the second switch element can also be quickly changed. Therefore, an electric charge in the capacitor can be discharged via the second switch element to supply an enough reset current to the operation coil to securely recover the single winding latching relay.

Effect of the Invention

A latching relay drive circuit according to the present invention is disposed with a first switch element and a diode so that the latching relay drive circuit is almost free from an effect of drop in voltage supplied from a power supply even if a power supply voltage drops while an operation switch is kept closed when the power supply is shut off. Therefore, if the power supply is shut off due to a power failure or other failures, an enough reset current can be supplied to securely recover a single winding latching relay.

MODE FOR CARRYING OUT THE INVENTION

First Embodiment (Configuration of Latching Relay Drive Circuit 1)

Figure 1:
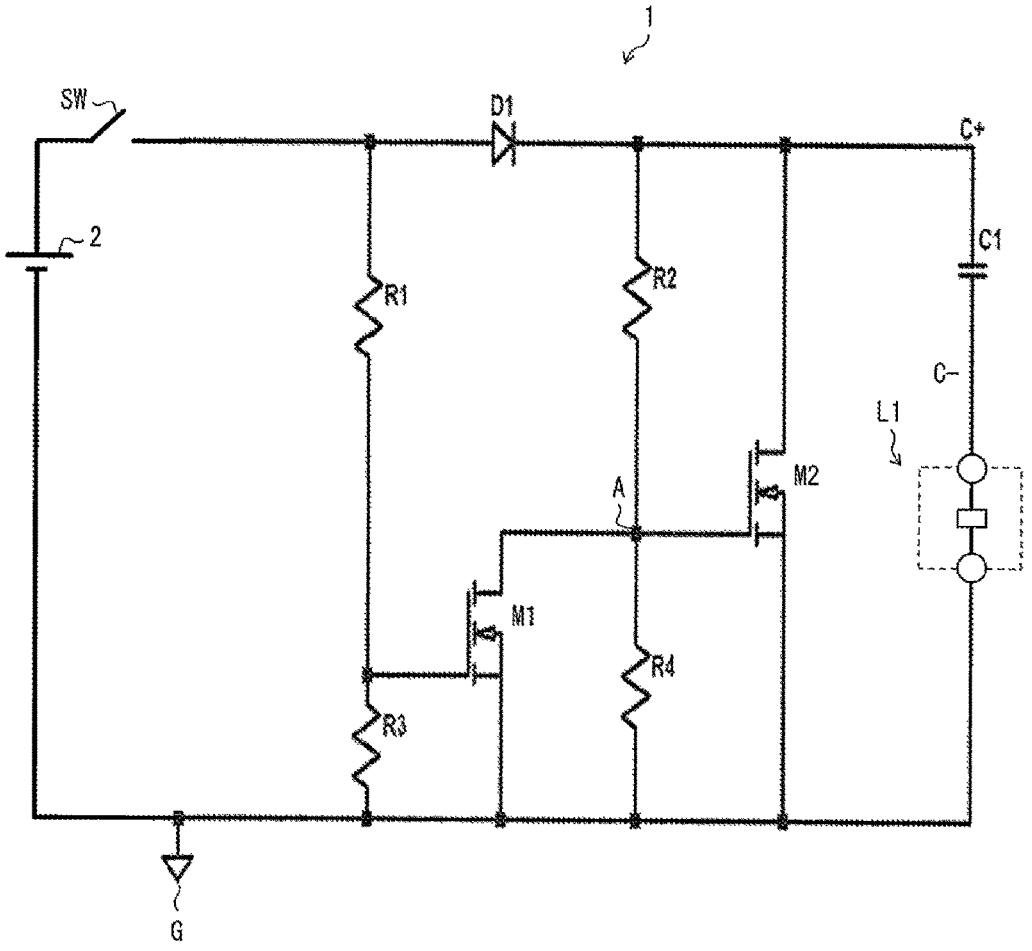
FIG. 1 is a circuit diagram illustrating a configuration of a latching relay drive circuit according to a first embodiment.

FIG. 1 is a circuit diagram illustrating a configuration of a latching relay drive circuit 1 according to a first embodiment. The latching relay drive circuit 1 includes an operation coil L1 disposed in a single winding latching relay, and its internal resistor R5. A capacitor C1 is connected in series to the operation coil L1.

The latching relay drive circuit 1 is disposed with a transistor M2 (first switch element) connected in parallel to the capacitor C1 and the operation coil L1. A drain terminal of the transistor M2 is connected to a constant potential, for example, a ground G.

The latching relay drive circuit 1 includes a power supply 2 and a switch SW disposed to charge the capacitor C1 with the power supply 2 to allow a set current to flow into the operation coil L1. A diode D1 is disposed between the switch SW and the capacitor C1.

The capacitor C1 includes a positive capacitor terminal corresponding to a positive terminal of the power supply 2 and a negative capacitor terminal corresponding to a negative terminal of the power supply 2. The negative capacitor terminal of the capacitor C1 is connected to the ground G via the operation coil L1 and the internal resistor R5 so that potential at the negative terminal is kept constant.

The latching relay drive circuit 1 is disposed with a voltage-dividing resistor R2 in which an end is coupled to the diode D1, and another end is coupled to a gate terminal of the transistor M2, and a voltage-dividing resistor R4 in which an end is coupled to the gate terminal of the transistor M2, and another end is coupled to the ground G.

The latching relay drive circuit 1 includes a transistor M1 (second switch element) that comes on when the switch SW is closed, and goes off when the switch SW is open. A source terminal of the transistor M1 is coupled to the gate terminal of the transistor M2. The drain terminal of the transistor M2 is connected to the ground G.

The latching relay drive circuit 1 is disposed with a voltage-dividing resistor R1 in which an end is coupled to the diode D1, and another end is coupled to a gate terminal of the transistor M1, and a voltage-dividing resistor R3 in which an end is coupled to the gate terminal of the transistor M1, and another end is coupled to the ground G.

An inductance of the operation coil L1 and a value of the internal resistor R5 differ depending on a type of a latching relay. However, the description herein uses, for example, the operation coil L1 having an inductance of 40 mH, and an internal resistor having a resistance of 40Ω.

An electrostatic capacitance value of the capacitor C1 is specified so that pulse widths of a set current and a reset current each has an enough duration for operating the latching relay. For example, the equation shown below is used to determine an electrostatic capacitance value.

$$C1=3AA/R5$$

Where, AA is a pulse width of a current required to operate the latching relay. The width differs depending on a type of the latching relay. For example, a type with AA=10 msec is used. When the values of the pulse width AA and the internal resistor R5 are substituted into the above equation, a guide result can be obtained with C1=3×0.01/40=0.75 mF. Herein the value is specified to C1=1 mF.

The voltage-dividing resistors R1 and R3 are determined so that a voltage divided by the voltage-dividing resistors R1 and R3 is equal to or above a drive voltage for the transistor M1. For example, when the transistor M1 with a type where a drive voltage is 1.5 V is used in a system with a power supply voltage of 12 V, R1 and R3 are determined so that R3 is greater in ratio than a ratio of R1:R3=7:1. For example, when the voltage-dividing resistor R1 having a resistance of 200 kΩ and the voltage-dividing resistor R3 having a resistance of 470 kΩ are used, a voltage divided by R1 and R2 is 12 V×470 k/(200 k+470 k)=8.4 V. In this case, the voltage becomes equal to or above the drive voltage of 1.5 V, thus the transistor M1 can be operated. The voltage-dividing resistors R2 and R4 are determined in a manner similar or identical to a manner for determining the voltage-dividing resistors R1 and R3.

(Operation of Latching Relay Drive Circuit 1)

First, at an instant when the switch SW is closed to turn an input voltage $V_{in}$ from off to on, the voltage-dividing resistors R1 and R3 divide the input voltage $V_{in}$ so that the transistor M1 comes on. When the transistor M1 comes on, the gate of the transistor M2 is connected to the ground G via the transistor M1 so that the transistor M2 goes off. As a result, a set current flows from the power supply 2, via the switch SW, the diode D1, the capacitor C1, and the operation coil L1, toward the ground G.

Next, when the switch SW is open to turn the input voltage $V_{in}$ from on to off, a voltage between the gate and the source of the transistor M1 drops equal to or below the drive voltage so that the transistor M1 goes off. When the transistor M1 goes off, a voltage at a point "A" becomes equal to a voltage divided from a charging voltage in the capacitor C1 with the voltage-dividing resistors R2 and R4 so that the transistor M2 comes on. When the transistor M2 comes on, the electric charge in the capacitor C1 discharges to allow a reset current to flow into the operation coil L1. That is, the reset current flows from the positive terminal of the capacitor C1, via the transistor M2 and the operation coil L1, toward the negative terminal of the capacitor C1.

Figure 11:
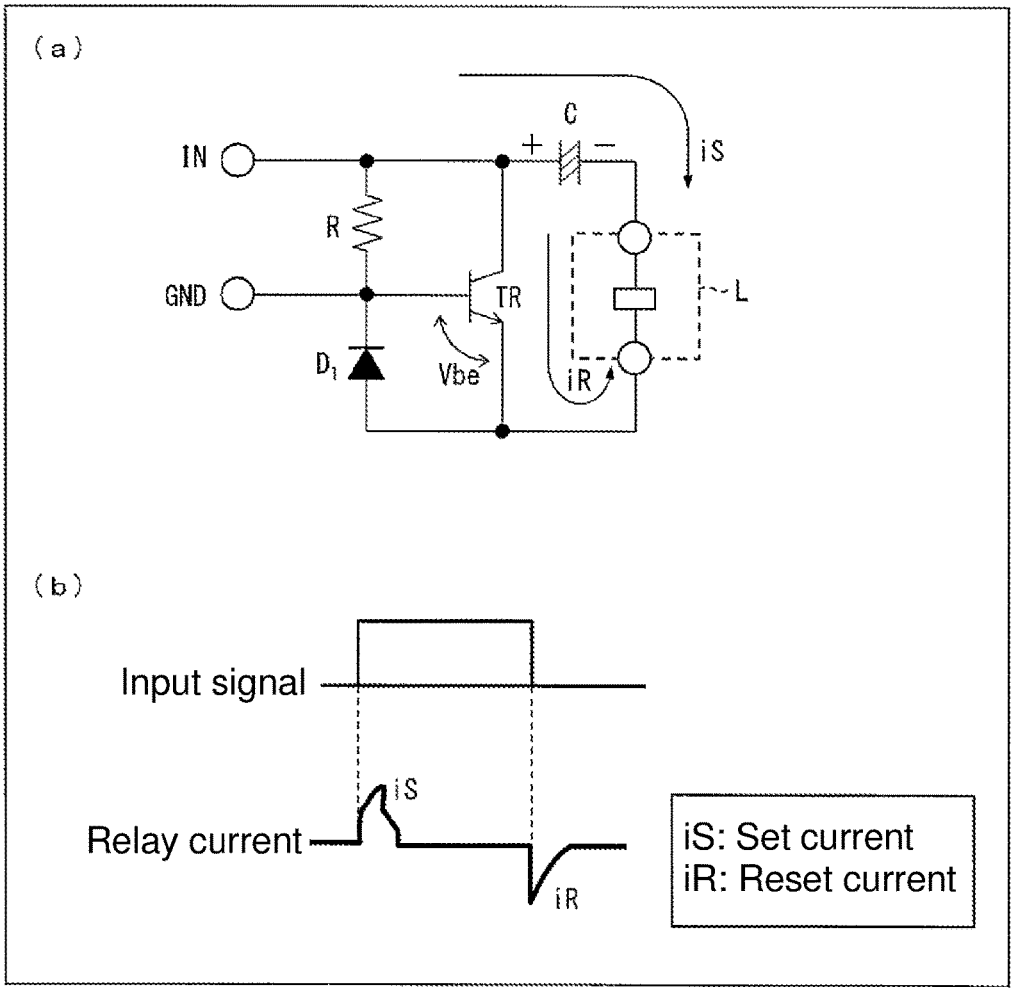
FIG. 11(*a*) is a circuit diagram for describing an operation of the conventional latching relay drive circuit, and FIG. 11(*b*) is a waveform chart illustrating an input signal into the above-described latching relay drive circuit and a coil current flowing in a coil in a latching relay.
Figure 12:
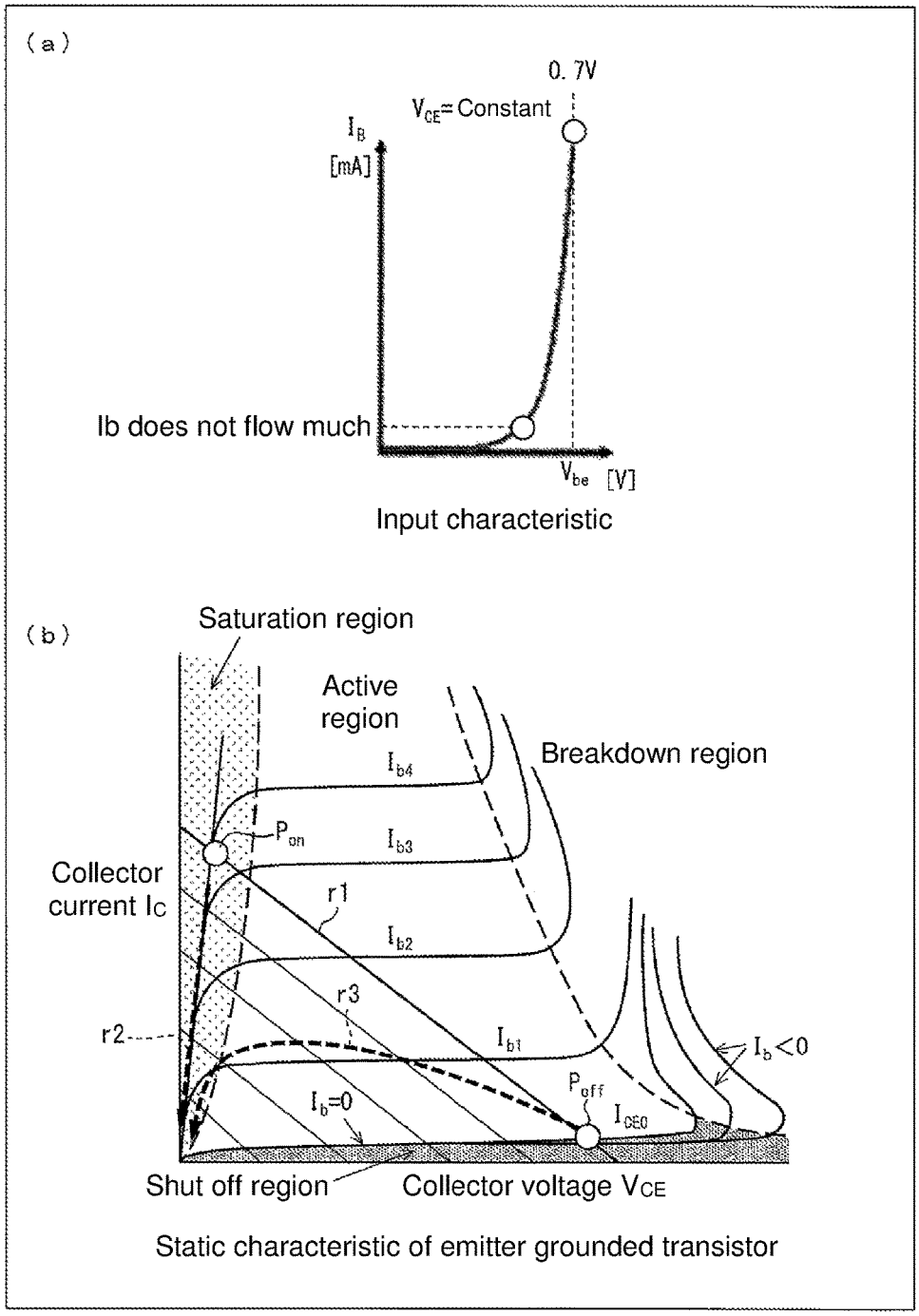
FIG. 12(*a*) is a graph illustrating a relationship between a base current and a voltage between a base and an emitter of a transistor disposed in the above-described latching relay drive circuit, and FIG. 12(*b*) is a graph illustrating a static characteristic between a collector voltage and a collector current in the above-described transistor.
Figure 13:
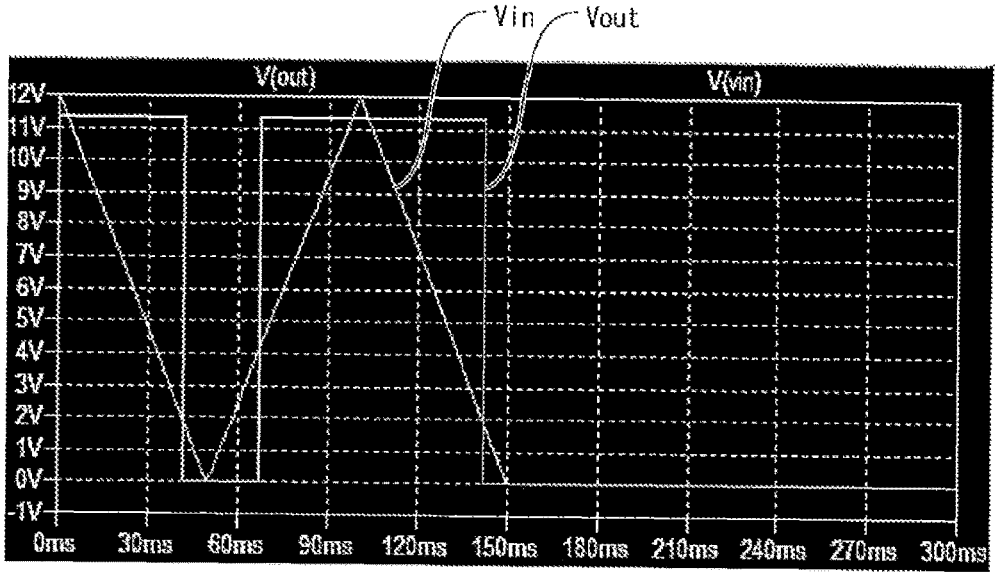
FIG. 13 is a waveform chart illustrating an input voltage and an output voltage in a Schmitt circuit, in a normally off operation of the above-described latching relay drive circuit.
Figure 14:
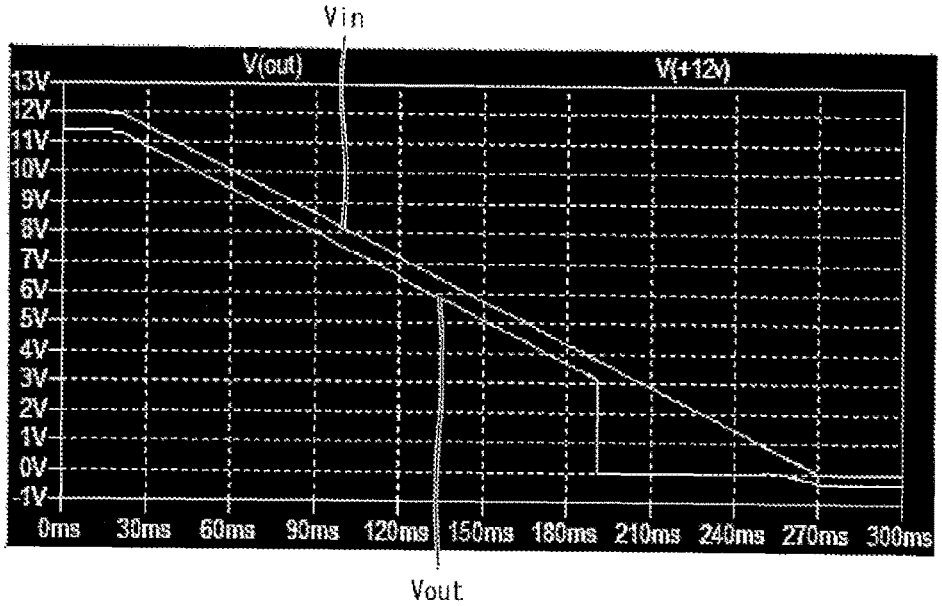
FIG. 14 is a waveform chart illustrating an input voltage and an output voltage in the Schmitt circuit, in an off operation of the above-described latching relay drive circuit when the power supply is shut off.
Figure 15:
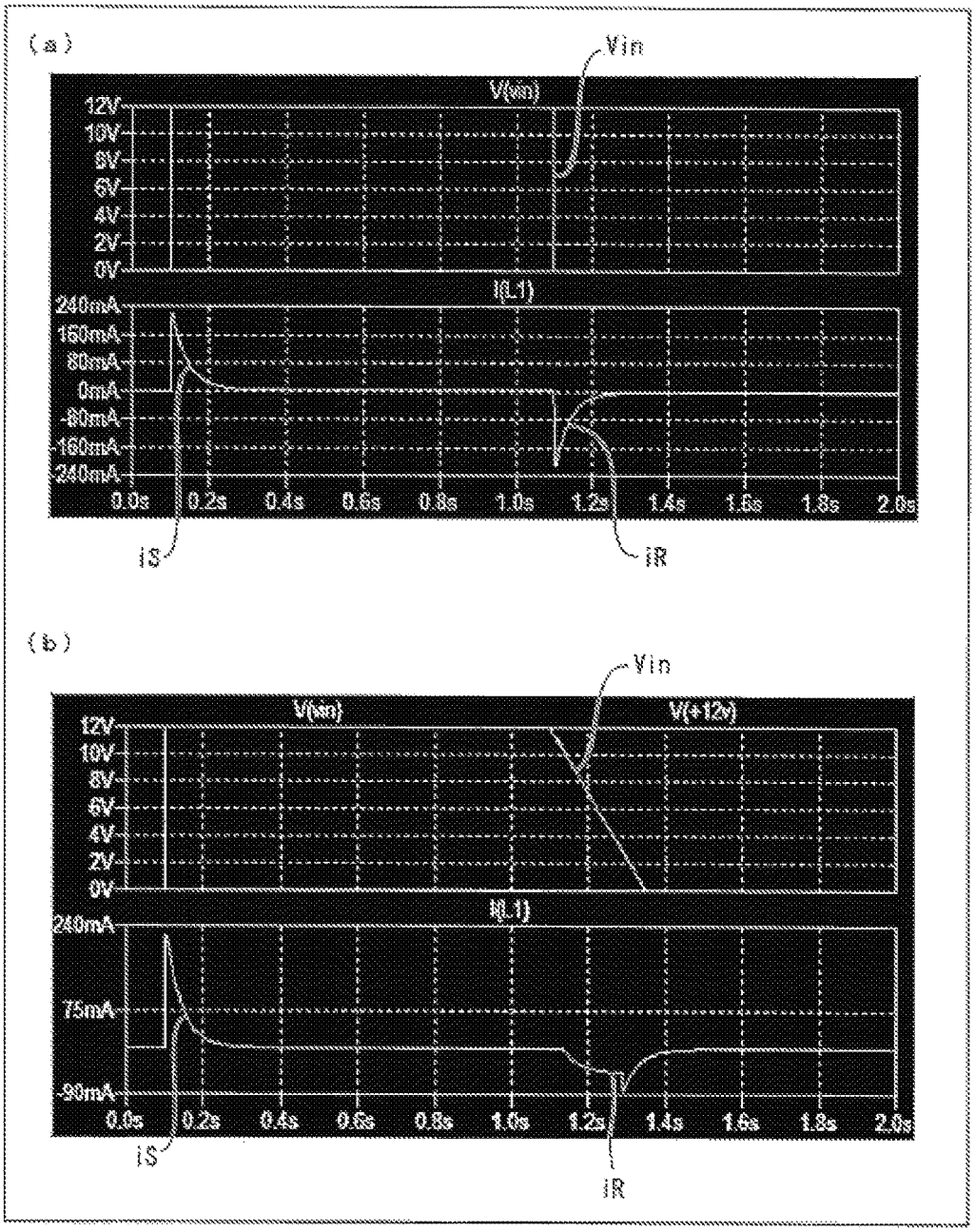
FIG. 15(*a*) is a waveform chart illustrating an input voltage and a reset current in a normally off operation of the above-described latching relay drive circuit that uses a bipolar transistor, and FIG. 15(*b*) is a waveform chart illustrating an input voltage and a reset current in an off operation when the power supply is shut off.
Figure 16:
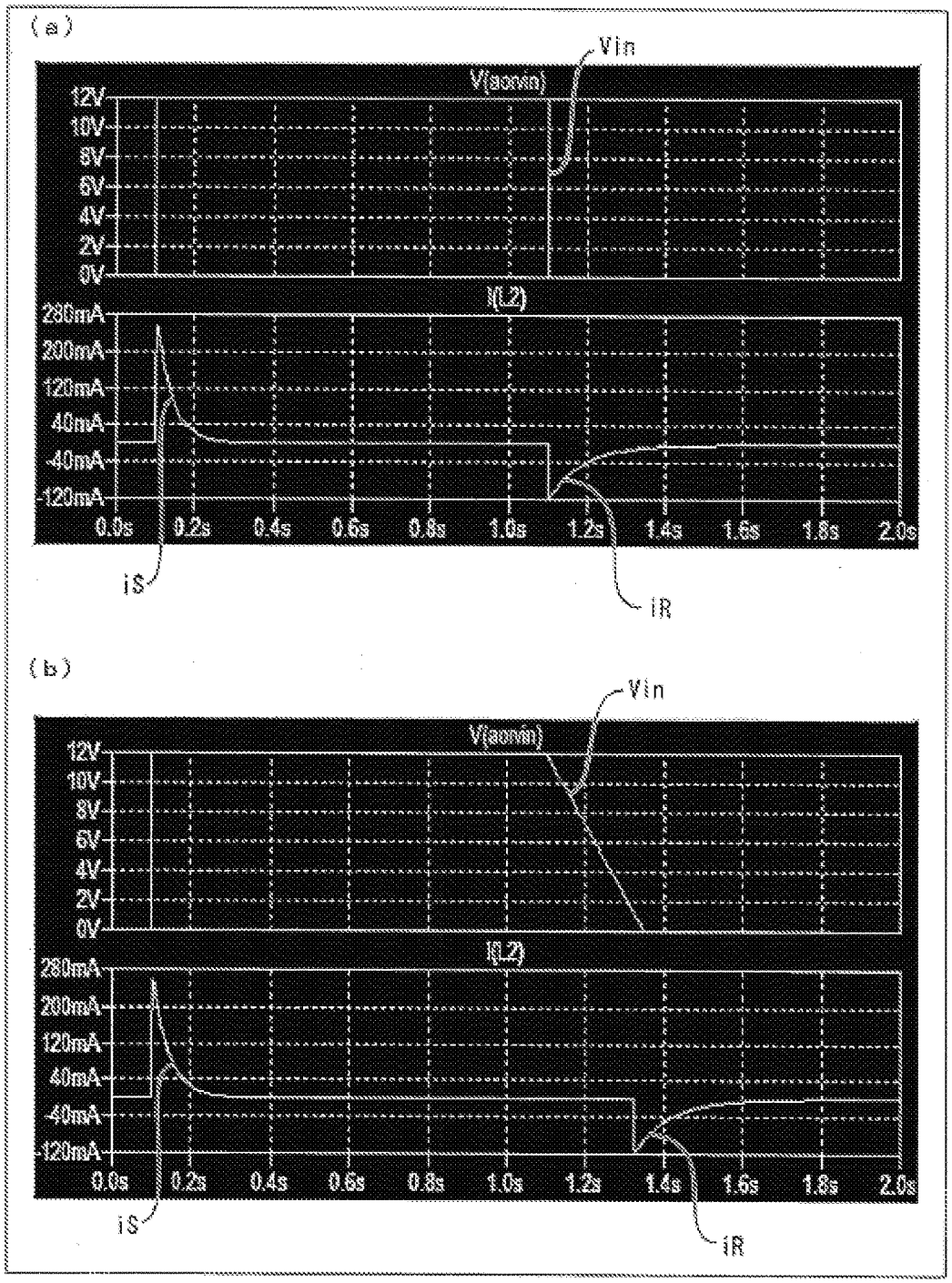
FIG. 16(*a*) is a waveform chart illustrating an input voltage and a reset current in a normally off operation of the other above-described latching relay drive circuit, and FIG. 16(*b*) is a waveform chart illustrating an input voltage and a reset current in an off operation when the power supply is shut off.

With the conventional latching relay drive circuit described previously in FIGS. 11(*a*) and 11(*b*), when the input voltage $V_{in}$ turns from on to off, a voltage between the positive terminal and the negative terminal of the capacitor C drops in synchronization with the input voltage $V_{in}$, while a potential difference is kept maintained, thus a loss occurs until the transistor comes on. On the other hand, with the latching relay drive circuit 1 according to the embodiment, during a period between when the transistor M1 goes off and when the transistor M2 comes on, a potential at the negative terminal of the capacitor C1 is determined by the ground G, and the positive terminal of the capacitor C1 is isolated by the diode D1 from the power supply 2 and a circuit on the switch SW side. Therefore, the voltage between the positive terminal and the negative terminal of the capacitor C1 gradually drops while a voltage at the positive terminal of the capacitor C1 discharges via the voltage-dividing resistor R2, rather than drops in synchronization with the input voltage $V_{in}$ while the potential difference is kept maintained. A rate of drop in voltage at the positive terminal of the capacitor C1 is determined by a time constant determined by the capacitor C1 and the voltage-dividing resistor R2. Therefore, discharge of electricity from the capacitor until a reset current is allowed to flow can be reduced by designing a time constant determined by the capacitor C1 and the voltage-dividing resistor R2 is long enough (for example, not less than one second) with respect to a voltage drop period in the system when the power supply is shut off (the period differs depending on the system, however, 250 msec or shorter, generally).

Even when the input voltage $V_{in}$ drops so that the transistor M1 goes off, an enough electric charge is retained in the capacitor, the transistor M2 comes on instantaneously. Therefore, a loss in the transistor M2 can be reduced.

Figure 2:
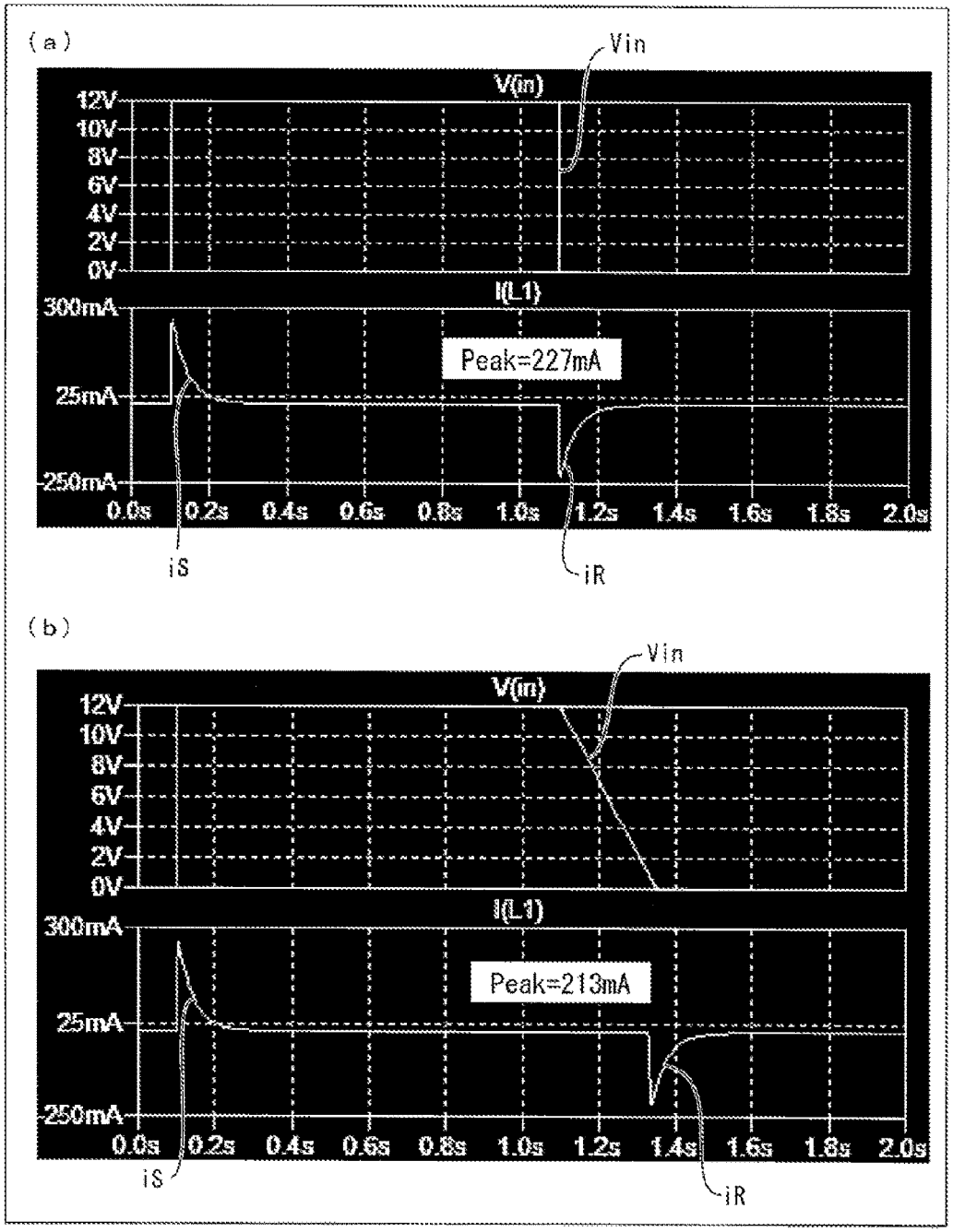
FIG. 2(*a*) is a waveform chart illustrating an input voltage and a reset current in a normally off operation of the above-described latching relay drive circuit, and FIG. 2(*b*) is a waveform chart illustrating an input voltage and a reset current in an off operation when a power supply is shut off.

FIG. 2(*a*) is a waveform chart illustrating an input voltage $V_{in}$ and a reset current iR in a normally off operation of the latching relay drive circuit 1, and FIG. 2(*b*) is a waveform chart illustrating an input voltage $V_{in}$ and a reset current iR in an off operation when the power supply is shut off.

With reference to FIG. 2(*a*), when the switch SW is closed at a time of 0.1 s to quickly change the input voltage $V_{in}$ from 0 V to 12 V, a set current iS flows. And then, when the switch SW is open at a time of 1.1 s to quickly change the input voltage $V_{in}$ from 12 V to 0 V, a reset current iR flows. A peak value of this reset current iR is 227 mA.

That is, when the switch SW is switched from a closed state to an open state, the transistor M1 switches from an on state to an off state, and the transistor M2 switches from an off state to an on state. At this time, an electric charge in the capacitor C1 is discharged via the transistor M2 to allow a reset current iR to flow into the operation coil L1.

With reference to FIG. 2(*b*), when the switch SW is closed at a time of 0.1 s to quickly change the input voltage $V_{in}$ from 0 V to 12 V, as same as FIG. 2(*a*), a set current iS flows. And then, when the power supply is shut off due to a power failure, while the switch SW is kept closed, at a time of 1.1 s, the input voltage $V_{in}$ starts to gently drop from 12 V, and, at a time of 1.35 s, the input voltage $V_{in}$ reaches 0 V. When a voltage divided from the input voltage $V_{in}$ with the voltage-dividing resistors R1 and R2 drops below the drive voltage of the transistor M1, the transistor M1 goes off, and the transistor M2 comes on to allow a reset current iR to flow. A peak value of this reset current iR is 213 mA, which does not lower significantly from a peak value of a reset current iR in a normally off operation, differently from a conventional configuration. Therefore, even if the power supply is shut off due to a power failure, an enough reset current can be supplied to securely recover the single winding latching relay.

Figure 3:
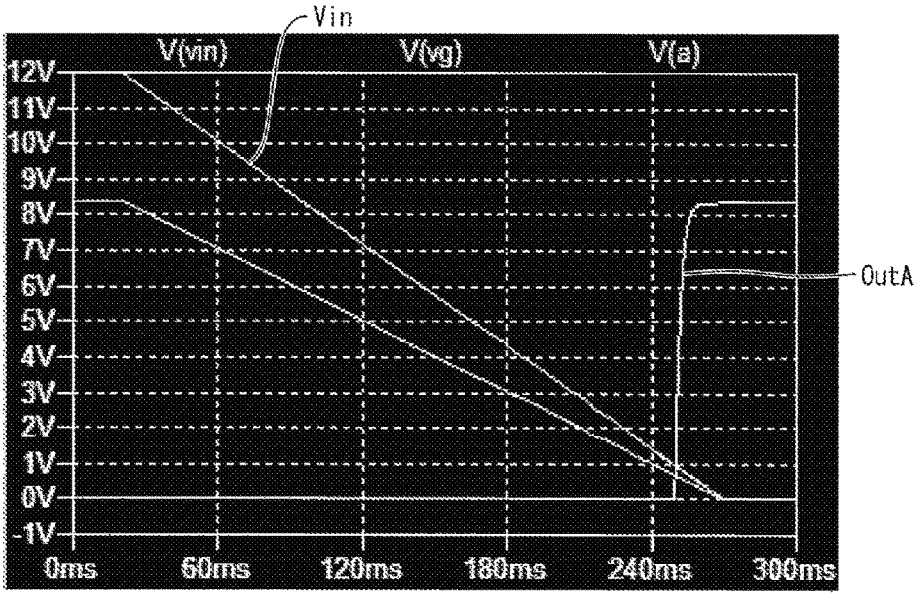
FIG. 3 is a waveform chart illustrating an input voltage, and an output voltage from a first switch element, in the above-described off operation when the power supply is shut off.

FIG. 3 is a waveform chart illustrating an input voltage $V_{in}$, and a voltage OutA at the point "A" shown in FIG. 1, in the above-described off operation when the power supply is shut off. In FIG. 3, the power supply is shut off due to a power failure, while the switch SW is kept closed, at a time of 20 ms, where the input voltage $V_{in}$ starts to drop from 12 V, and, at a time of 270 ms, the input voltage $V_{in}$ reaches 0 V. That is, when a period during which the input voltage $V_{in}$ drops from 12 V to 0 V is 250 msec (when a fall time from 90% to 10% is 200 msec), the voltage OutA quickly responses within 5 msec (rise time from 10% to 90%). At this point, a voltage drop period of 250 msec is longer enough than a time to response by the transistor M1 (generally, approximately 100 nanoseconds), and this 5 msec is a value determined by an input/output characteristic (static characteristic) of the transistor M1. That is, a rise time of the transistor M1 depends on a performance of the transistor M1.

In the latching relay drive circuit 1 according to the first embodiment, the transistor M1 can quickly change even if a drop rate of the input voltage $V_{in}$ lowers when the power supply is shut off due to a power failure. As a result, an input voltage into the gate terminal of the transistor M2 in a subsequent step quickly changes, thus the transistor M2 can further quickly switch.

(Effect of Latching Relay Drive Circuit 1)

Figure 4:
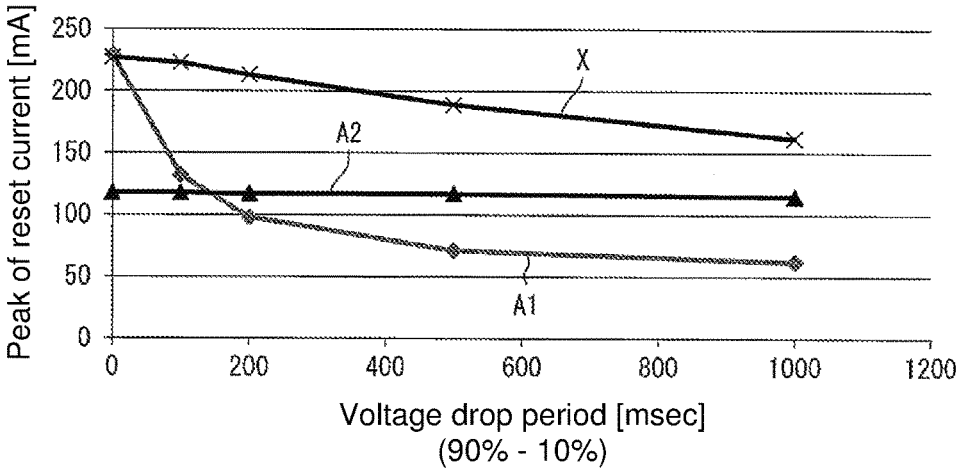
FIG. 4 is a graph illustrating relationships between voltage drop periods and peaks of reset currents in the above-described latching relay drive circuit and conventional drive circuits.
Figure 9:
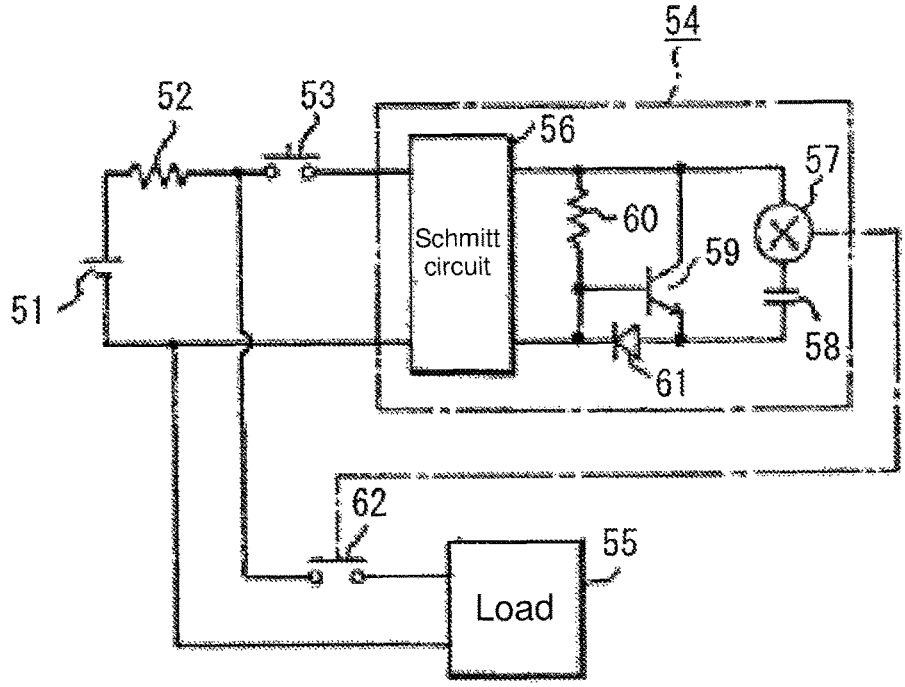
FIG. 9 is a circuit diagram illustrating a configuration of the conventional latching relay drive circuit.
Figure 10:
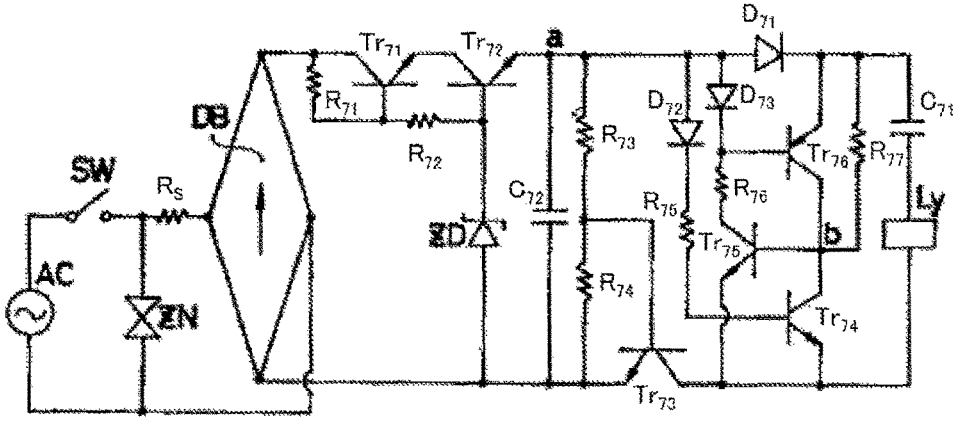
FIG. 10 is a circuit diagram illustrating a configuration of another conventional latching relay drive circuit.

FIG. 4 is a graph illustrating relationships between voltage drop periods and peaks of reset currents in the above-described latching relay drive circuit and the conventional drive circuits. A line X indicates a relationship between a peak value of a reset current and a voltage drop period in the latching relay drive circuit 1 according to the first embodiment. A line A1 indicates the above-described relationship in the conventional latching relay drive circuit shown in FIG. 9. A line A2 indicates the above-described relationship in the other conventional latching relay drive circuit shown in FIG. 10.

In the latching relay drive circuit 1 according to the first embodiment, a reset current flows in a normally off operation (with a voltage drop period of 0 msec), at a level similar or identical to a level observed in a conventional latching relay drive circuit. Even in a case where a power supply voltage gently drops due to a power failure or other failures (with a voltage drop period of 200 msec (when a power supply voltage before such a power failure is specified to 100%, a period required by the power supply voltage to drop from 90% to 10%)), the latching relay drive circuit 1 allows a more reset current to flow, comparing with the conventional drive circuits shown in FIGS. 9 and 10.

Second Embodiment

Figure 5:
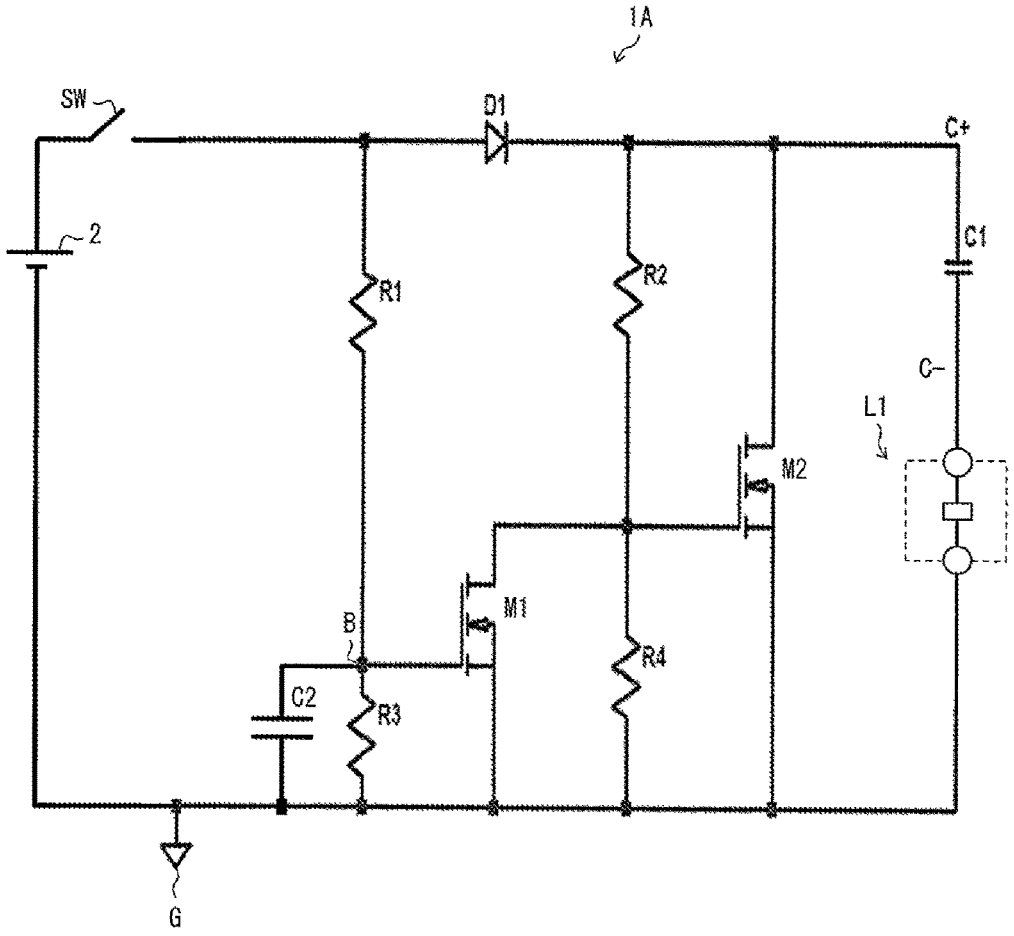
FIG. 5 is a circuit diagram illustrating a configuration of a latching relay drive circuit according to a second embodiment.

FIG. 5 is a circuit diagram illustrating a configuration of a latching relay drive circuit 1A according to a second embodiment. Those components identical to the components of the first embodiment described previously are applied with identical reference symbols and numerals, and detailed descriptions will not be repeated to those components.

The latching relay drive circuit 1A is disposed with an off-delay capacitor C2 connected in parallel to the voltage-dividing resistor R3. An end of the off-delay capacitor C2 is coupled to a point "B" positioned between the voltage-dividing resistor R1 and the voltage-dividing resistor R3, and another end is coupled to the ground G.

Figure 6:
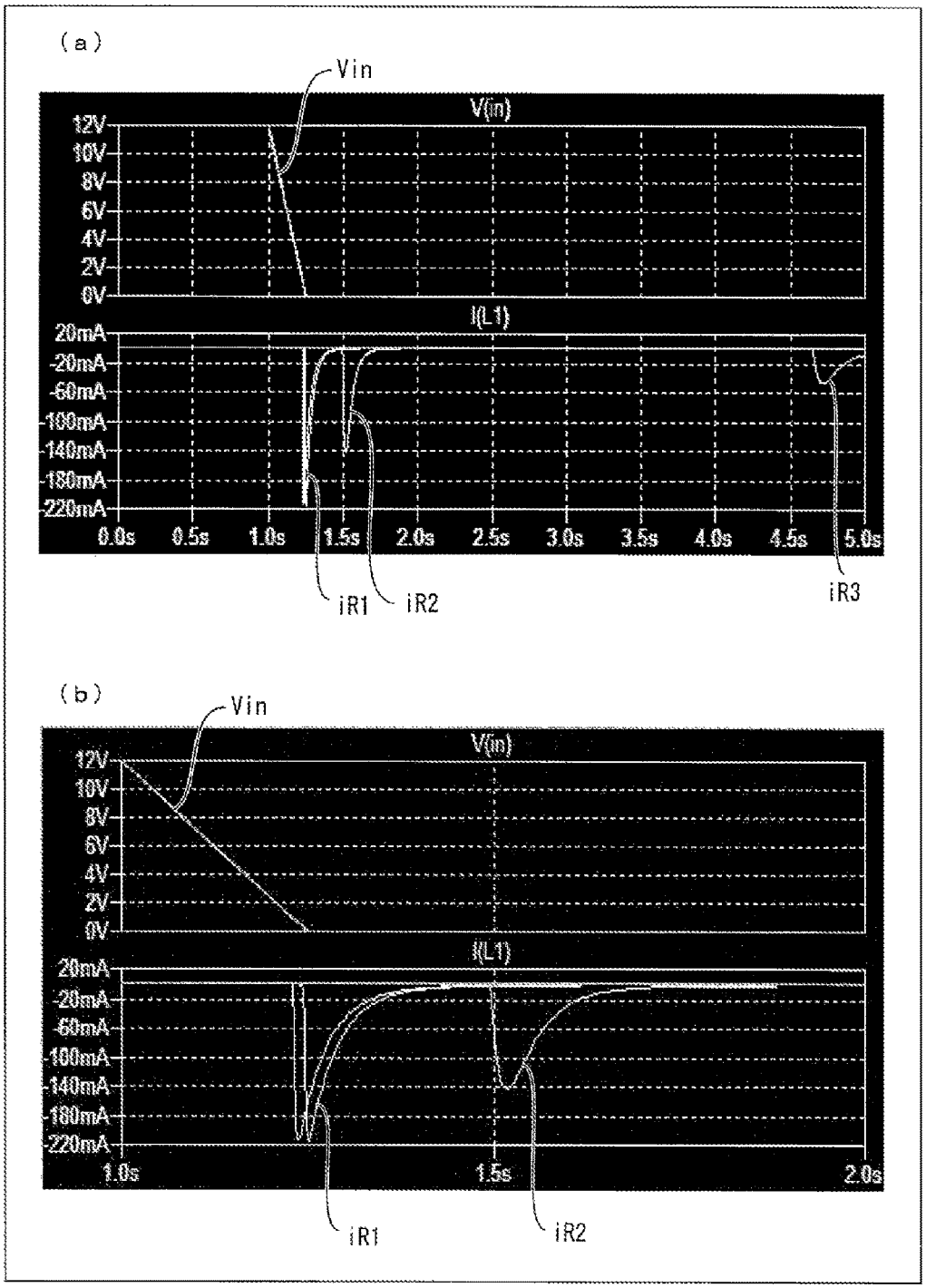
FIGS. 6(*a*) and 6(*b*) are waveform charts for describing input voltages and reset currents in an off operation of the above-described latching relay drive circuit when the power supply is shut off.

FIGS. 6(*a*) and 6(*b*) are waveform charts for describing input voltages and reset currents in an off operation of the latching relay drive circuit 1A when a power supply is shut off. A period from when the power supply is shut off due to a power failure, and the transistor M2 comes on, to when a reset current is supplied to the operation coil L1 can be set with a time constant determined by the voltage-dividing resistors R1 and R3 and the off-delay capacitor C2.

At a time of 1.0 sec, the input voltage $V_{in}$ starts to drop from 12 V due to a power failure, and, at a time of 1.25 sec, the input voltage $V_{in}$ reaches 0 V. When a capacitance of the off-delay capacitor C2 is specified to 0.1 μF, a reset current iR1 flows by the time constant determined by the voltage-dividing resistors R1 and R3 and the off-delay capacitor C2 after a delay of 14 msec, comparing with a case where there is no off-delay capacitor.

When the electrostatic capacitance of the off-delay capacitor C2 is specified to 1 μF, a reset current iR2 flows by the time constant determined by the voltage-dividing resistors R1 and R3 and the off-delay capacitor C2 after a delay of 280 msec, comparing with a case where there is no off-delay capacitor. On the other hand, when the electrostatic capacitance of the off-delay capacitor C2 is specified to 10 μF, a reset current iR3 flows after a delay of 3.5 sec, comparing with a case where there is no off-delay capacitor.

Figure 7:
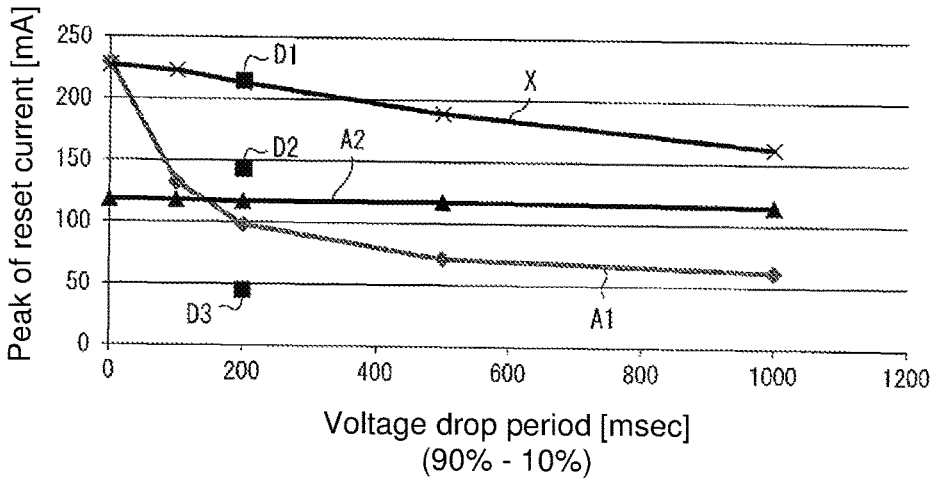
FIG. 7 is a graph illustrating relationships between voltage drop periods and peaks of reset currents in the above-described latching relay drive circuit and the conventional drive circuits.

FIG. 7 is a graph illustrating relationships between voltage drop periods and peaks of reset currents in the latching relay drive circuit 1A and the conventional drive circuits. The lines X, and A1 to A3 are identical to those described previously with reference to FIG. 4.

A point "D1" indicates a relationship between a peak of a reset current and a voltage drop period in a case when an electrostatic capacitance of the off-delay capacitor C2 is specified to 0.1 μF, with a delay of 14 msec. A point "D2" indicates the above-described relationship in a case when an electrostatic capacitance of the off-delay capacitor C2 is specified to 1 μF, with a delay of 280 msec. A point "D3" indicates the above-described relationship in a case when an electrostatic capacitance of the off-delay capacitor C2 is specified to 10 μF, with a delay of 3.5 sec. Although setting an excessive delay period reduces a peak of a reset current, as can be seen at the point "D3," an enough reset current can be secured, while providing a delay period, as can be seen at the points "D1" and "D2," by properly setting the delay period.

Delaying a timing for supplying a reset current can delay a timing for turning off a relay. Therefore, when a latching relay drive circuit is used as a power supply relay, for example, an operation required as a latching relay drive circuit system can be carried out before the relay turns off to shut off power to be supplied to a subsequent circuit.

Third Embodiment

Figure 8:
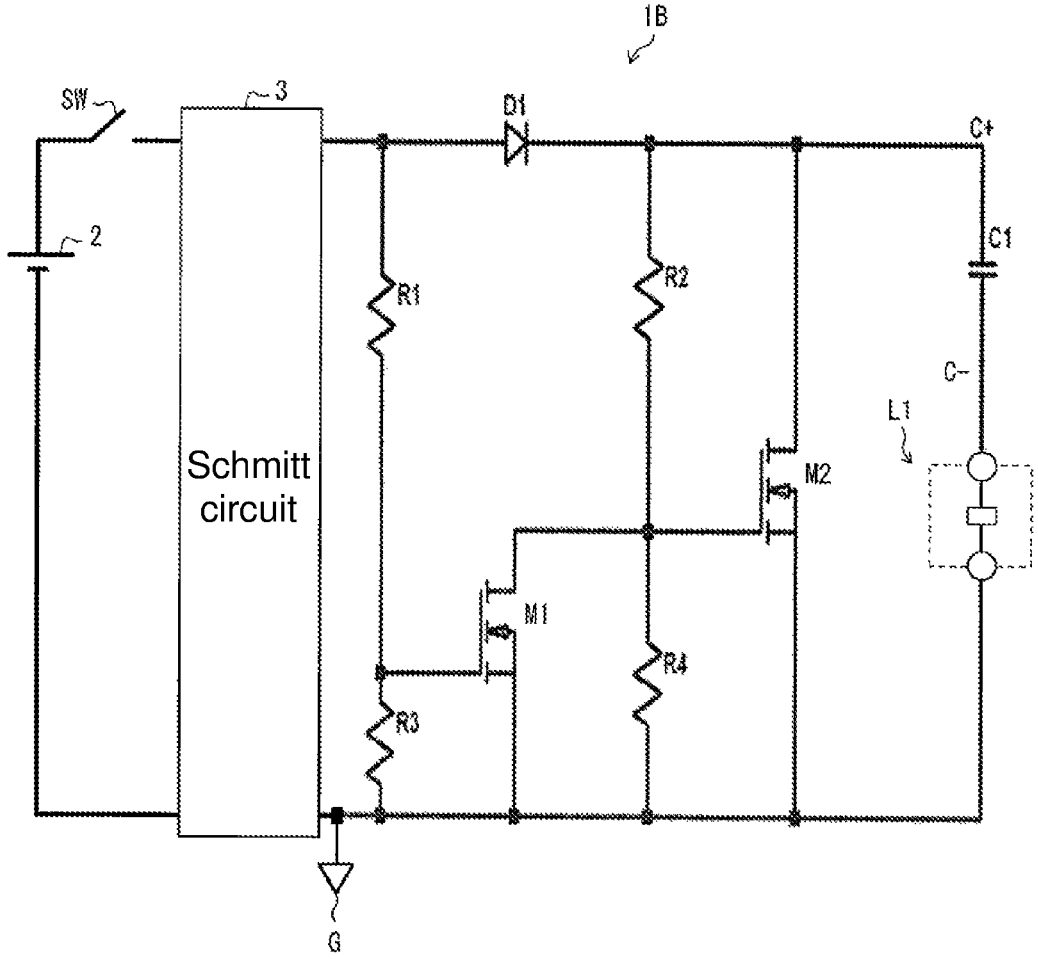
FIG. 8 is a circuit diagram illustrating a configuration of a latching relay drive circuit according to a third embodiment.

FIG. 8 is a circuit diagram illustrating a configuration of a latching relay drive circuit 1B according to a third embodiment. Those components identical to the components of the first embodiment described previously are applied with identical reference symbols and numerals, and detailed descriptions will not be repeated to those components.

The latching relay drive circuit 1B includes a Schmitt circuit 3. A pair of inputs into the Schmitt circuit 3 is respectively coupled to the switch SW and the negative terminal of the power supply 2. A pair of outputs from the Schmitt circuit 3 is respectively coupled to the diode D1 and the ground G. In this way, a latching relay drive circuit may be combined with a Schmitt circuit.

Fourth Embodiment

Figure 17:
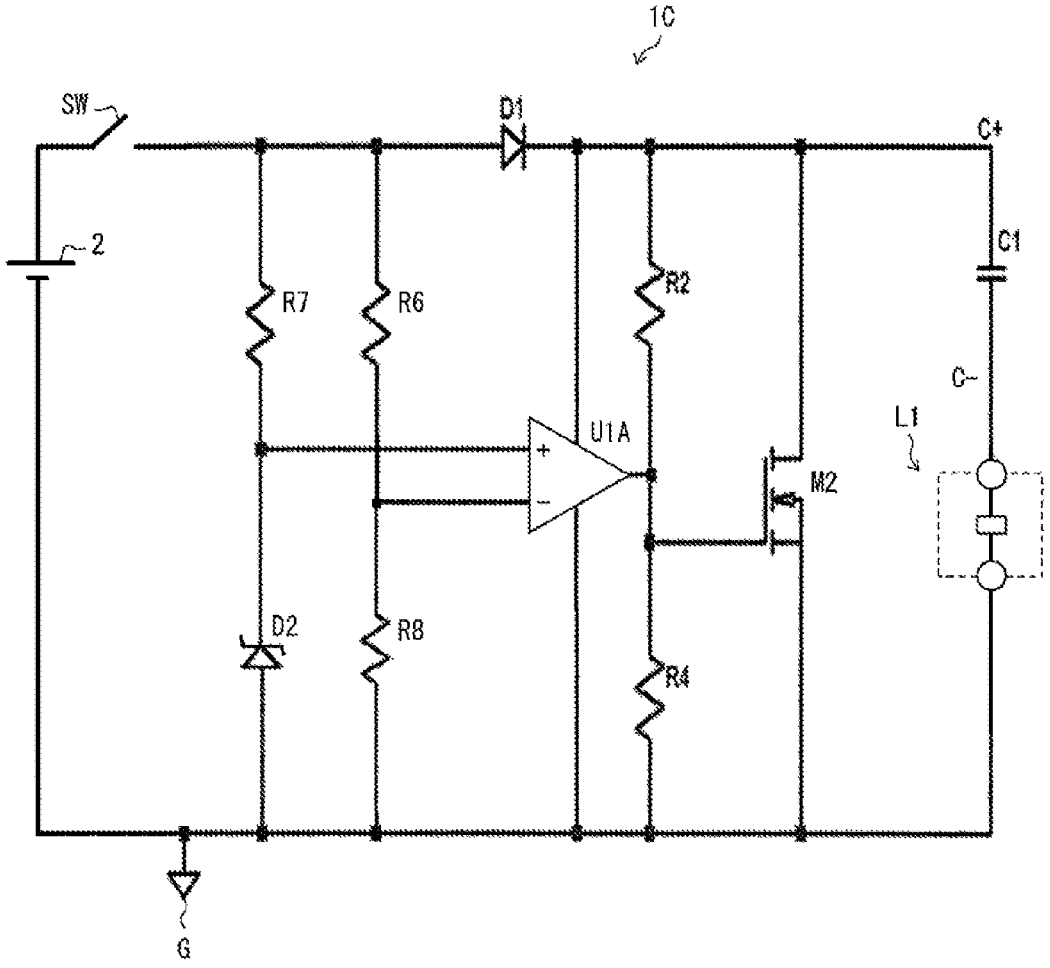
FIG. 17 is a circuit diagram illustrating a configuration of a latching relay drive circuit according to a fourth embodiment.

FIG. 17 is a circuit diagram illustrating a configuration of a latching relay drive circuit 1C according to a fourth embodiment. Those components identical to the components of the first embodiment described previously are applied with identical reference symbols and numerals, and detailed descriptions will not be repeated to those components.

Instead of the transistor M1, the voltage-dividing resistor R1, and the voltage-dividing resistor R3 in the latching relay drive circuit 1 according to the first embodiment, the latching relay drive circuit 10 includes a comparator U1A, a resistor R6, a resistor R7, a resistor R8, and a Zener diode D2.

An end of the resistor R6 is coupled to the diode D1 and the switch SW, and another end of the resistor R6 is coupled to an inverting input terminal of the comparator U1A. An end of the resistor R7 is coupled to the diode D1 and the switch SW, and another end of the resistor R7 is coupled to a non-inverting input terminal of the comparator U1A.

An end of the resistor R8 is coupled to the resistor R6 and the inverting input terminal of the comparator U1A, and another end of the resistor R8 is coupled to the ground G. A cathode of the Zener diode D2 is coupled to the resistor R7 and the non-inverting input terminal of the comparator U1A, and an anode of the Zener diode D2 is coupled to the ground G.

An output terminal of the comparator U1A is connected to the gate terminal of the transistor M2. In addition, a positive voltage supply terminal of the comparator U1A is coupled to a cathode of the diode D1 and the capacitor C1, and a negative voltage supply terminal of the comparator U1A is coupled to the ground G.

A resistance value of each of the resistor R6 and the resistor R8 is set so that, in a state where the switch SW is closed to normally supply power from the power supply 2, a breakdown voltage Vz of the Zener diode D2 lowers below a voltage Vr between the resistor R6 and the resistor R8, i.e. the voltage Vr divided from a power supply voltage with the resistor R6 and the resistor R8.

(Operation of Latching Relay Drive Circuit 10)

First, at an instant when the switch SW is closed to turn an input voltage $V_{in}$ from off to on, a voltage at the non-inverting input terminal of the comparator U1A becomes equal to the breakdown voltage Vz of the Zener diode D2. On the other hand, a voltage at the inverting input terminal of the comparator U1A becomes equal to the voltage Vr between the resistor R6 and the resistor R8.

At this point, in a state where the switch SW is closed to normally supply power from the power supply 2, as described above, the breakdown voltage Vz is below the voltage Vr between the resistor R6 and the resistor R8. Therefore, the voltage at the inverting input terminal of the comparator U1A is higher than the voltage at the non-inverting input terminal, thus an output from the comparator U1A becomes "Low," and a level of an output voltage becomes equal to a ground G level. Accordingly, a level at the gate of the transistor M2 becomes equal to the ground G level, thus the transistor M2 goes off. As a result, a set current flows from the power supply 2, via the switch SW, the diode D1, the capacitor C1, and the operation coil L1, toward the ground G.

Next, when the switch SW is open to turn the input voltage $V_{in}$ from on to off, the voltage at the non-inverting input terminal of the comparator U1A is kept equal to the breakdown voltage Vz for the Zener diode D2. On the other hand, the voltage at the inverting input terminal of the comparator U1A, i.e. the voltage Vr between the resistor R6 and the resistor R8, drops as the supplied voltage drops. At a time when the breakdown voltage Vz exceeds the voltage Vr between the resistor R6 and the resistor R8, the output from the comparator U1A becomes "High," and the output voltage becomes a charging voltage of the capacitor C1. This output voltage of the comparator U1A causes the transistor M2 to come on. After the transistor M2 comes on, an electric charge in the capacitor C1 discharges to allow a reset current to flow into the operation coil L1. That is, the reset current flows from the positive terminal of the capacitor C1, via the transistor M2 and the operation coil L1, toward the negative terminal of the capacitor C1.

As described above, the latching relay drive circuit 1C according to the fourth embodiment can achieve an operation similar or identical to the operation of the latching relay drive circuit 1 according to the first embodiment.

(Configuration Variations)

The switch SW may be configured with a semiconductor switch. In addition, although examples in which the switch SW is disposed on a positive terminal side of the power supply 2 have been described, the present invention is not limited to these examples, but the switch SW may be disposed on a negative terminal side of the power supply 2. This configuration may also be applied to the latching relay drive circuits 1 and 1A respectively according to the first and second embodiments.

Although examples in which polarity capacitors are used for the capacitors C1 and C2 have been described, the present invention is not limited to these examples. A non-polarity capacitor can be applied to the present invention. Such a non-polarity capacitor is generally highly reliable, but is often expensive as a capacitance of the non-polarity capacitor increases. Some configurations may use a somewhat expensive, but highly reliable non-polarity capacitor, instead of an inexpensive, large capacitance polarity capacitor. In addition, when an electromagnetic relay with a type that allows a reset current to flow in a short period (the previously described current pulse width AA required for operating a latching relay) is used in a drive circuit, the drive circuit may be configured with a non-polarity capacitor.

Although a reset current should be evaluated with a current value and a duration required for resetting (a pulse width AA of a current required for operating a latching relay), the reset current has been evaluated with a peak value since the duration can freely be designed with a capacitance of a capacitor. If a peak value of a reset current is smaller than a peak value of a current required for resetting, no resetting can be carried out regardless of a designed capacitance of a capacitor. In addition, a larger peak value of a reset current can preferably reduce a capacitance of a capacitor satisfying a duration (a pulse width AA of a current required as described above). That is, a capacitor having a smaller capacitance can lead to a small-sized, inexpensive configuration. In this way, since a design factor is an increase in a peak value of a reset current, a peak value of a reset current has been used for evaluation and comparison with conventional technologies.

The voltage-dividing resistor R1, R3, or R4 may be replaced with a Zener diode. In addition, the voltage-dividing resistors R1 and R4 may be replaced with Zener diodes, as well as the voltage-dividing resistors R3 and R4 may be replaced with Zener diodes. In addition, the transistors M1 and M2 may not be FETs (Field-Effect Transistors), but may be configured with other switching elements, for example, bipolar transistors.

CONCLUSION

Each of the latching relay drive circuits according to some aspects of the present invention includes an operation coil (operation coil L1) disposed in a single winding latching relay, a capacitor (capacitor C1) connected in series to the operation coil, an operation switch (switch SW) disposed for charging the capacitor with a power supply (power supply 2) to allow a set current to flow into the operation coil, a single first switch element that is a single first switch connected in parallel to both ends of a series circuit including the operation coil and the capacitor, and that, when the first switch element (transistor M2) comes on, forms a closed circuit including the series circuit to allow a current discharged from the capacitor, a first switch element drive circuit into which, when the operation switch is open or a failure in supplying power from the power supply occurs, the current discharged from the capacitor and applied to a signal input unit (gate terminal) of the first switch element flows, and a discharge preventing element (diode D1) preventing the current discharged from the capacitor from being flowed into other than the first switch element drive circuit while the operation switch is open or there is a failure in supplying power from the power supply.

In addition, each of the latching relay drive circuits according to some aspects of the present invention may be configured to further include, in the above-described configurations, a detection circuit detecting that the operation switch is open or there is a failure in supplying power from the power supply to change a state of the first switch element drive circuit so that the current discharged from the capacitor flows into the first switch element drive circuit.

In addition, each of the latching relay drive circuits according to some aspects of the present inventions may be configured in such a manner that, in the above-described configurations, the first switch element drive circuit is configured with a second voltage-dividing circuit connected in parallel to the first switch element, with respect to the series circuit including the operation coil and the capacitor, and the second voltage-dividing circuit may include a pair of second voltage-dividing elements (voltage-dividing resistors R2 and R4), where, between the pair of second voltage-dividing elements, the detection circuit and a signal input unit of the first switch element are connected.

According to the above-described configuration, when the detection circuit detects that the operation switch is open or there is a failure in supplying power from the power supply, the detection circuit operates to change a potential state in the signal input unit of the first switch element. Accordingly, without being affected by a rate of drop in voltage supplied from the power supply, a current discharged from the capacitor can be input into the signal input unit of the first switch element.

In addition, each of the latching relay drive circuits according to some aspects of the present invention may be configured in such a manner that, in the above-described configurations, the detection circuit includes a second switch element (transistor M1), where a voltage that changes as when the operation switch is open or there is a failure in supplying power from the power supply is applied to a signal input unit (gate terminal) of the second switch element to change, through a switching operation of the second switch element, a state of the first switch element drive circuit.

According to the above-described configuration, even if a rate of drop in voltage supplied from the power supply is low, for example, a speed of a switching operation of the second switch element does not change. Therefore, without being affected by a rate of drop in voltage supplied from the power supply, a state of the first switch element drive circuit can be changed through the switching operation of the second switch element.

In addition, each of the latching relay drive circuits according to some aspects of the present invention may be configured in such a manner that, in the above-described configurations, the detection circuit includes a first voltage-dividing circuit connected to the power supply via the operation switch, where the first voltage-dividing circuit includes a pair of first voltage-dividing elements (voltage-dividing resistors R1 and R3), the signal input unit of the second switch element is connected between the pair of first voltage-dividing elements, and a voltage-dividing ratio for the pair of first voltage-dividing elements is specified so that, when the operation switch is open or there is a failure in supplying power from the power supply, the second switch element turns to an on state.

According to the above-described configuration, the second switch element can precisely turn to the on state as when the operation switch is open or there is a failure in supplying power from the power supply.

In addition, each of the latching relay drive circuits according to some aspects of the present invention may be configure in such a manner that, in the above-described configurations, the detection circuit includes a comparator (comparator U1A), and a voltage that changes as when the operation switch is open or there is a failure in supplying power from the power supply is applied to the non-inverting input terminal and the inverting input terminal of the comparator to change a state of the first switch element drive circuit as when an output from the comparator changes.

According to the above-described configuration, even if a rate of drop in voltage supplied from the power supply is low, for example, a speed of change in output from the comparator does not change. Therefore, without being affected by a rate of drop in voltage supplied from the power supply, a state of the first switch element drive circuit can be changed by a change in output from the comparator.

In addition, each of the latching relay drive circuits according to the present invention may be configured in such a manner the second voltage-dividing element, disposed on a side of the operation switch, of the pair of second voltage-dividing elements is a resistor, and a time constant determined by the resistor and the capacitor is not less than one second.

According to the above-described configuration, even if a power supply voltage drops while the operation switch is kept closed, an electric charge in the capacitor can be prevented from being discharged before the second switch element is turned off, i.e. before a reset current flows. Therefore, an enough reset current can be supplied to the operation coil to securely recover the single winding latching relay. Specifically, even if an unintentional failure in supplying power occurs due to a power failure or other failures, instead of opening the operation switch, a time to discharge an electric charge in the capacitor via the second voltage-dividing element (resistor) can be extended longer than a period of a voltage drop in the latching relay drive circuit (the period differs depending on a system, but 200 milliseconds or shorter, generally). Therefore, even when the second switch element is turned off, a reset current can be supplied to the operation coil.

In addition, each of the latching relay drive circuits according to the present invention may be configured to include an off-delay capacitor connected in parallel to the first voltage-dividing element, disposed on a side opposite to the operation switch, of the pair of first voltage-dividing elements.

According to the above-described configuration, a timing to supply a reset current to the operation coil after the power supply is shut off due to a power failure can be adjusted.

Moreover, the present invention is not limited to each of the above-described embodiments, but can be variously modified within the scope of the claims, where embodiments obtained by appropriately combining technical means disclosed in each of the different embodiments are also included in the technical scope of the present invention.

INDUSTRIAL APPLICABILITY

The present invention can be used in a latching relay drive circuit for driving a single winding latching relay that operates or recovers when an excitation input is added to an coil, and keeps its state after the excitation input is removed.

DESCRIPTION OF SYMBOLS

1, 1A, 1B, 1C: latching relay drive circuit
2: power supply
3: Schmitt circuit
L1: operation coil
C1: capacitor
SW: switch
M1: transistor (second switch element)
M2: transistor (first switch element)
R1, R3: voltage-dividing resistor
R2, R4: voltage-dividing resistor
R6, R7, R8: resistor
C2: off-delay capacitor
D1: diode
D2: Zener diode
G: ground (constant potential)
U1A: comparator

The invention claimed is:

1. A latching relay drive circuit comprising:

an operation coil disposed in a single winding latching relay;

a capacitor connected in series to the operation coil;

an operation switch disposed to charge the capacitor with a power supply to allow a set current to flow into the operation coil;

a first switch element connected in parallel to a series circuit comprising the operation coil and the capacitor to form a closed circuit comprising the series circuit when the first switch element is turned on to allow a current discharged from the capacitor to flow;

a first switch element drive circuit, connected in parallel to the first switch element, in which the current discharged from the capacitor flows, the current being applied to a signal input unit of the first switch element in response to the operation switch being open or in response to a failure occurring in supplying power from the power supply; and a discharge preventing element configured to prevent the current discharged from the capacitor from flowing into other than the first switch element drive circuit and the first switch element in response to the operation switch being open or in response to the failure in supplying power from the power supply.

2. The latching relay drive circuit according to claim 1, further comprising a detection circuit detecting that the operation switch is open or that the failure is occurring in supplying power from the power supply to change a state of the first switch element drive circuit so that the current discharged from the capacitor flows into the first switch element drive circuit.

3. The latching relay drive circuit according to claim 2, wherein the first switch element drive circuit comprises a second voltage-dividing circuit connected in parallel to the first switch element, the second voltage-dividing circuit comprises a pair of second voltage-dividing elements connected in series, and the detection circuit and the signal input unit of the first switch element are connected between the pair of second voltage-dividing elements.

4. The latching relay drive circuit according to claim 2, wherein the detection circuit comprises a second switch element, a voltage that changes when the operation switch opens or the failure occurs in supplying power from the power supply is applied to a signal input unit of the second switch element, and a state of the first switch element drive circuit is changed by a switching operation of the second switch element.

5. The latching relay drive circuit according to claim 4, wherein the detection circuit comprises a first voltage-dividing circuit connected to the power supply via the operation switch, the first voltage-dividing circuit comprises a pair of first voltage-dividing elements, a signal input unit of the second switch element is connected between the pair of first voltage-dividing elements, and a voltage-dividing ratio for the pair of first voltage-dividing elements is specified so that the second switch element turns to an on state when the operation switch opens or the failure occurs in supplying power from the power supply.

6. The latching relay drive circuit according to claim 2, wherein the detection circuit comprises a comparator, a voltage that changes when the operation switch opens or a failure occurs in supplying power from the power supply occurs is applied to a non-inverting input terminal and an inverting input terminal of the comparator, and a state of the first switch element drive circuit changes when an output from the comparator changes.

7. A latching relay drive circuit comprising:

a first voltage-dividing circuit connected to a power supply via an operation switch;

a second voltage-dividing circuit connected via a diode from a connection unit with the operation switch of the first voltage-dividing circuit;

a first switch element connected in parallel to the second voltage-dividing circuit; and an LC circuit connected in parallel to the second voltage-dividing circuit, the LC circuit comprising an operation coil of a single winding latching relay and a capacitor, wherein the diode is disposed to face in a forward direction from the first voltage-dividing circuit to the second voltage-dividing circuit, the first voltage-dividing circuit comprises a pair of first voltage-dividing elements, the second voltage-dividing circuit comprises a pair of second voltage-dividing elements, a signal input unit of a second switch element is connected between the pair of first voltage-dividing elements, a current input unit of the second switch element and a signal input unit of the first switch element are connected between the pair of second voltage-dividing elements, a current output unit of the second switch element is connected to a side opposite to the operation switch of the power supply, a voltage-dividing ratio for the pair of first voltage-dividing elements is specified so that, when the operation switch is closed, the second switch element turns to an on state, a voltage-dividing ratio for the pair of second voltage-dividing elements is specified so that, when a charging voltage based on an electric charge in the capacitor is applied to the second voltage-dividing circuit, the first switch element turns to an on state, and when the operation switch is switched from a closed state to an open state, the second switch element turns from the on state to an off state, at the same time, the first switch element turns from an off state to the on state to discharge an electric charge in the capacitor via the first switch element to allow a reset current to flow into the operation coil.

8. The latching relay drive circuit according to claim 3, wherein of the pair of second voltage-dividing elements, the second voltage-dividing element disposed on a side of the operation switch is a resistor, and a time constant determined by the resistor and the capacitor connected in series to the operation coil is not less than one second.

9. The latching relay drive circuit according to claim 5, comprising an off-delay capacitor connected in parallel to the first voltage-dividing element, disposed on a side opposite to the operation switch, of the pair of first voltage-dividing elements.

10. The latching relay drive circuit according to claim 7, wherein of the pair of second voltage-dividing elements, the second voltage-dividing element disposed on a side of the operation switch is a resistor, and a time constant determined by the resistor and the capacitor of the LC circuit is not less than one second.

11. The latching relay drive circuit according to claim 7, comprising an off-delay capacitor connected in parallel to the first voltage-dividing element, disposed on a side opposite to the operation switch, of the pair of first voltage-dividing elements.

* * * * *